US005908071A

United States Patent [19]

Hutchinson et al.

[11] Patent Number: 5,908,071

[45] **Date of Patent: *Jun. 1, 1999**

[54] WELLBORE MILLS AND INSERTS

[75] Inventors: Christopher P. Hutchinson, Houston; Guy L. McClung, III, Spring, both of Tex.

[73] Assignee: Weatherford/Lamb, Inc., Houston, Tex.

[ * ] Notice: This patent is subject to a terminal disclaimer.

[21] Appl. No.: 08/846,092

[22] Filed: May 1, 1997

Related U.S. Application Data

[63] Continuation-in-part of application No. 08/532,474, Sep. 22, 1995, Pat. No. 5,626,189.

[51] Int. Cl.[6] ..... E21B 10/46

[52] U.S. Cl. ..... 166/55.6; 175/426; 407/116

[58] Field of Search ..... 166/55.6; 175/426, 175/430–432; 407/113–116

[56] References Cited

U.S. PATENT DOCUMENTS

| | | | |
|---|---|---|---|
| Re. 30,908 | 4/1982 | Friedline | 407/114 |
| D. 298,633 | 11/1988 | Kenemore | D15/139 |
| D. 317,010 | 5/1991 | Knemeyer | D15/21 |
| D. 330,206 | 10/1992 | Slutz | D15/139 |
| D. 337,335 | 7/1993 | Niebauer | D15/139 |
| 1,522,593 | 1/1925 | Pickin . | |
| 1,681,675 | 8/1928 | Miller . | |
| 2,328,494 | 8/1943 | Reaney | 29/105 |
| 2,333,653 | 11/1943 | Kraus | 407/55 |
| 2,370,273 | 2/1945 | Vlliman | 407/55 |
| 2,975,507 | 3/1961 | Wilder | 29/105 |

(List continued on next page.)

FOREIGN PATENT DOCUMENTS

| | | |
|---|---|---|
| 2431897 | 2/1980 | France . |
| 1070898 | 12/1959 | Germany . |
| 1579639 | 7/1990 | U.S.S.R. . |
| 2270097 | 1/1992 | United Kingdom . |
| 2280692 | 5/1993 | United Kingdom . |

OTHER PUBLICATIONS

"High Efficiency Metal Cutting Inserts," General Electric, p. 24; 1979.

"Turning Tools and Inserts," Sandvik Coromant, pp. 6, 34, 43, 46; 1984.

"NewsLine," Iscar, Ltd., pp. 3, 6, 9, 57, 58, 63, 66, 69, 70, 71; 1993.

"Kennametal Tooling Applications Program," Kennametal, Inc.; pp. 9, 52, 53, 54, 55.

"Quick Reference Catalog," Sandvik Coromant, pp. 2–6; 1994.

"Cut Grip Specials," Iscar, Ltd.; 1993.

Int'l Search Report, PCT/GB98/01117 with Notification of Transmittal.

*Primary Examiner*—Hoang C. Dang
*Attorney, Agent, or Firm*—Guy McClung

[57] ABSTRACT

A cutting insert for a tool for wellbore milling operations has been invented that has a body having a top, a bottom, and a base, and a plurality of cutting surfaces on the top of the body, one of the cutting surfaces at a different height above the base than the other cutting surface, each cutting surface defined by linear boundaries extending from a first edge of the cutting insert, and the linear boundaries parallel to each other, the plurality of cutting surfaces including at least two cutting surfaces including at least a first cutting surface and a second cutting surface, the second cutting surface at a height above the base which is greater than a height above the base of the first cutting surface. An array of cutting inserts has been invented that has a plurality of adjacent inserts, each insert with interlinking apparatus comprising a projection on each of a first portion of the inserts and a projection recess on each of a second portion of the inserts, and the inserts arranged so that a projection on one insert is positioned in a projection recess of an adjacent insert. A tool for wellbore milling operations has been invented with a milling surface with such cutting inserts.

23 Claims, 12 Drawing Sheets

U.S. PATENT DOCUMENTS

| | | | |
|---|---|---|---|
| 3,188,717 | 6/1965 | Heinlein | 29/96 |
| 3,381,349 | 5/1968 | Newcomer | 29/96 |
| 3,636,602 | 1/1972 | Owen | 29/95 |
| 3,701,187 | 10/1972 | Erkfritz | 29/95 |
| 3,875,631 | 4/1975 | Malinchak | 29/95 R |
| 3,947,937 | 4/1976 | Hertel | 29/95 R |
| 4,068,976 | 1/1978 | Friedline | 407/114 |
| 4,086,016 | 4/1978 | Goeke | 407/114 |
| 4,119,151 | 10/1978 | Smith | 166/298 |
| 4,140,431 | 2/1979 | Friedline et al. | 407/114 |
| 4,278,369 | 7/1981 | Jakobs et al. | 407/113 |
| 4,335,984 | 6/1982 | Zweekly | 407/114 |
| 4,340,325 | 7/1982 | Gowanlock | 407/116 |
| 4,449,864 | 5/1984 | Haque et al. | 407/113 |
| 4,472,093 | 9/1984 | Hamilton | 407/41 |
| 4,531,864 | 7/1985 | Bylund | 407/114 |
| 4,552,492 | 11/1985 | Komanduri et al. | 407/114 |
| 4,583,431 | 4/1986 | Komanduri et al. | 82/1 C |
| 4,588,332 | 5/1986 | Komanduri et al. | 407/114 |
| 4,593,777 | 6/1986 | Barr | 175/379 |
| 4,606,678 | 8/1986 | Zweekly | 407/114 |
| 4,618,009 | 10/1986 | Carter et al. | 175/267 |
| 4,629,371 | 12/1986 | Maeda et al. | 407/114 |
| 4,629,372 | 12/1986 | Huston | 407/116 |
| 4,655,648 | 4/1987 | Hellbergh | 407/42 |
| 4,705,434 | 11/1987 | Patterson et al. | 407/114 |
| 4,717,290 | 1/1988 | Reynolds et al. | 407/34 |
| 4,796,709 | 1/1989 | Lynde et al. | 166/55.6 |
| 4,844,643 | 7/1989 | Icks | 407/42 |
| 4,854,785 | 8/1989 | Lowe et al. | 407/115 |
| 4,872,520 | 10/1989 | Nelson | 175/430 |
| 4,887,668 | 12/1989 | Lynde et al. | 166/55.8 |
| 4,911,254 | 3/1990 | Keith | 175/329 |
| 4,934,879 | 6/1990 | VanBarneveld | 407/66 |
| 4,938,291 | 7/1990 | Lynde et al. | 166/55.8 |
| 4,946,318 | 8/1990 | David et al. | 407/42 |
| 4,969,779 | 11/1990 | Barten | 407/114 |
| 4,978,260 | 12/1990 | Lynde et al. | 166/55.6 |
| 4,984,488 | 1/1991 | Lunde et al. | 166/55.6 |
| 5,014,778 | 5/1991 | Lynde et al. | 166/55.6 |
| 5,028,175 | 7/1991 | Pawlik | 407/40 |
| 5,038,859 | 8/1991 | Lynde et al. | 166/55.6 |
| 5,044,840 | 9/1991 | Fouquer et al. | 407/114 |
| 5,058,666 | 10/1991 | Lynde et al. | 166/55.6 |
| 5,059,069 | 10/1991 | Lagerberg | 407/113 |
| 5,070,952 | 12/1991 | Neff | 175/426 |
| 5,076,739 | 12/1991 | Pano | 407/116 |
| 5,078,550 | 1/1992 | Satran et al. | 407/34 |
| 5,085,542 | 2/1992 | Nakayama et al. | 407/114 |
| 5,086,838 | 2/1992 | Cassel et al. | 166/55.6 |
| 5,112,162 | 5/1992 | Hartford et al. | 407/49 |
| 5,137,396 | 8/1992 | Durschinger | 407/116 X |
| 5,150,755 | 9/1992 | Cassel et al. | 166/55.6 |
| 5,158,401 | 10/1992 | Pawlik | 407/40 |
| 5,158,402 | 10/1992 | Satran et al. | 407/113 |
| 5,180,258 | 1/1993 | Bernadic | 407/114 |
| 5,181,564 | 1/1993 | Lindley et al. | 166/55.6 |
| 5,199,513 | 4/1993 | Stewart et al. | 175/73 |
| 5,209,611 | 5/1993 | Drescher | 407/114 X |
| 5,221,164 | 6/1993 | Allaire | 407/175 |
| 5,253,710 | 10/1993 | Carter et al. | 166/298 |
| 5,297,630 | 3/1994 | Lynde et al. | 166/297 |
| 5,318,115 | 6/1994 | Rouse | 166/55.7 |
| 5,341,873 | 8/1994 | Carter et al. | 166/117.5 |
| 5,373,900 | 12/1994 | Lynde et al. | 166/297 |
| 5,409,060 | 4/1995 | Carter | 166/237 |
| 5,425,417 | 6/1995 | Carter | 166/117.6 |
| 5,429,187 | 7/1995 | Beagrie et al. | 166/55.1 |
| 5,449,255 | 9/1995 | Katbi et al. | 407/114 |
| 5,452,759 | 9/1995 | Carter et al. | 166/117.6 |
| 5,456,312 | 10/1995 | Lynde et al. | 166/55.6 |
| 5,472,376 | 12/1995 | Olmstead et al. | 451/540 |
| 5,474,126 | 12/1995 | Lynde et al. | 166/17.6 |
| 5,630,681 | 5/1997 | Paya | 407/114 |
| 5,634,745 | 6/1997 | Wiman et al. | 407/113 |
| 5,706,906 | 1/1998 | Jurewicz et al. | 175/428 |
| 5,727,910 | 3/1998 | Leeb | 407/34 |
| 5,757,911 | 5/1998 | Satran et al. | 407/42 |
| 5,778,995 | 7/1998 | McGarian | 175/420.1 |
| 5,788,001 | 8/1998 | Matthias et al. | 175/432 |
| 5,791,409 | 8/1998 | Flanders | 166/55.8 |
| 5,791,422 | 8/1998 | Liang et al. | 175/374 |
| 5,791,423 | 8/1998 | Overstreet et al. | 175/375 |

FIG. 2F
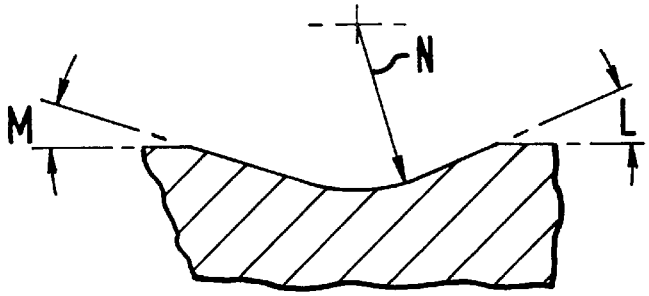
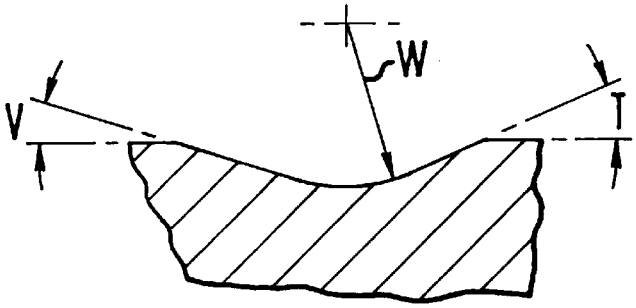
FIG. 2G
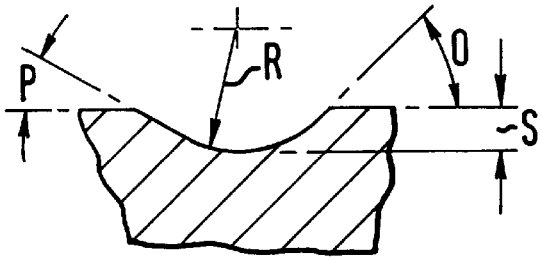
FIG. 2H
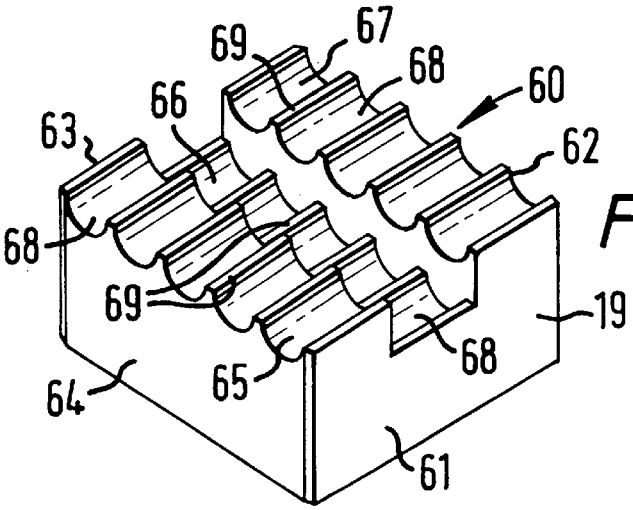
FIG. 3A
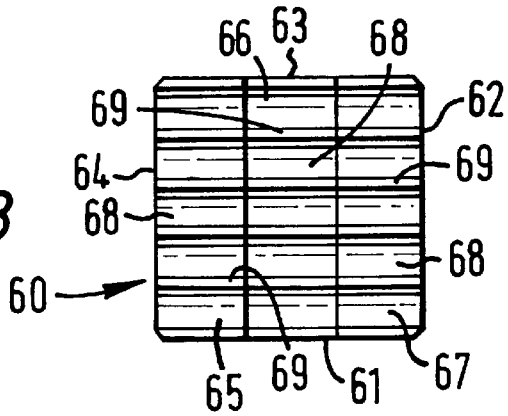
FIG. 3B FIG. 5A
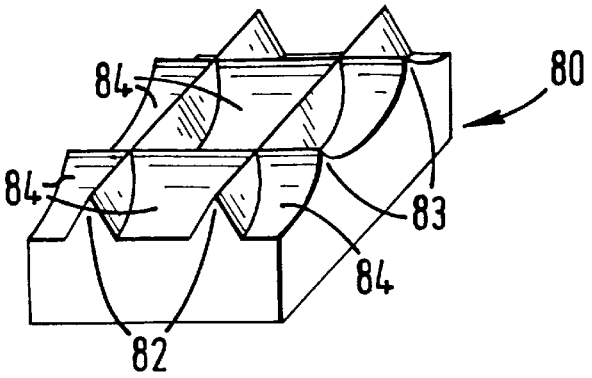
FIG. 5B
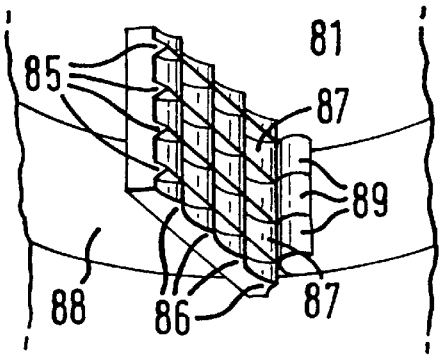
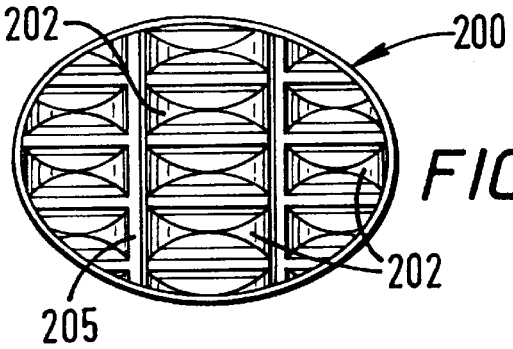
FIG. 8
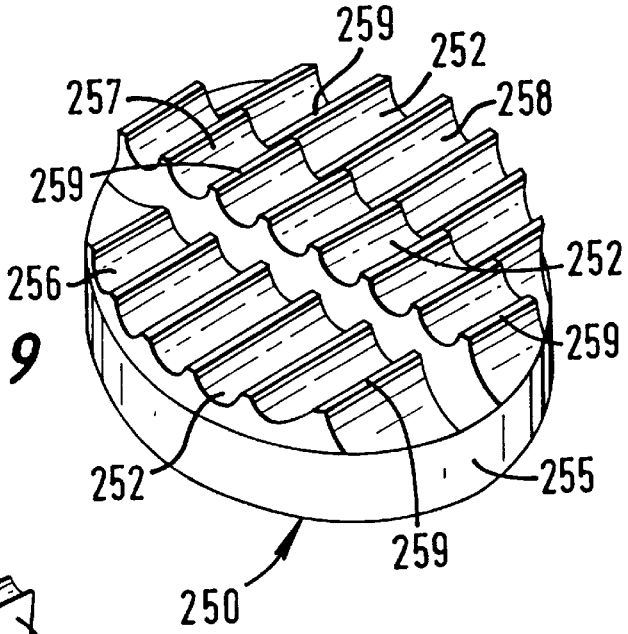
FIG. 9
FIG. 10
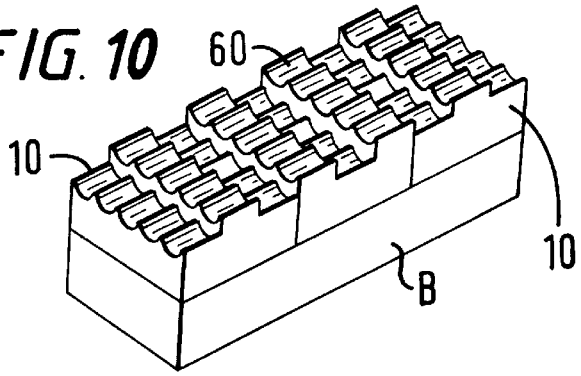

WELLBORE MILLS AND INSERTS

RELATED APPLICATION

This is a continuation-in-part of U.S. Application Ser. No. 08/532,474 filed Sep. 22, 1995 and issued as U.S. Pat. No. 5,626,189 on May 6, 1997.

BACKGROUND OF THE INVENTION

1. Field of the Invention

This invention is related to wellbore milling processes, wellbore milling tools, and cutting inserts for such tools.

2. Description of Related Art

Milling tools are used to cut out windows or pockets from a tubular, e.g. for directional drilling and sidetracking; and to mill out for removal materials downhole in a wellbore, such as pipe, casing, casing liners, tubing, or jammed tools (a "fish").

The prior art discloses various types of milling or cutting tools provided for milling out a fish or for cutting or milling existing pipe or casing previously installed in a well. These tools have cutting blades or surfaces and are lowered into the well or casing and then rotated in a milling/cutting operation. With certain tools, a suitable drilling fluid is pumped down a central bore of a tool for discharge beneath the cutting blades or surfaces and an upward flow of the discharged fluid in the annulus outside the tool removes from the well cuttings or chips resulting from the cutting operation.

Milling tools have been used for removing a section of existing casing from a well bore to permit a sidetracking operation in directional drilling, to provide a perforated production zone at a desired level, to provide cement bonding between a small diameter casing and the adjacent formation, or to remove a loose joint of surface pipe. Also, milling tools are used for milling or reaming collapsed casing, for removing burrs or other imperfections from windows in the casing system, for placing whipstocks in directional drilling, or for aiding in correcting dented or mashed-in areas of casing or the like.

The prior art discloses a variety of cutting inserts for wellbore milling tools. Certain of these inserts have a surface irregularity, recess, or indentation that serves as a chipbreaker to break a cutting being produced by an insert to limit the length of the cuttings. Certain prior art inserts have multiple chipbreakers on a single insert.

There has long been a need for an efficient and effective milling method in which the size of milled cuttings is controlled and optimized. There has long been a need for a cutting insert for wellbore milling tools which produces cuttings or chips at a desired rate and of a desired size. There has long been a need for tools with such inserts. There has long been a need for milling methods using such tools and such inserts.

SUMMARY OF THE PRESENT INVENTION

The present invention, in one embodiment, discloses a multi-level cutting insert for wellbore milling operations. In certain embodiments such an insert has a body with a plurality of cutting surfaces at different heights on the body. In one aspect the surfaces are stair-stepped from left-to-right or right-to-left, and there are two, three, or more cutting surfaces, and planes in which the surfaces are disposed are parallel or, in other embodiments, are not parallel. In another aspect a lower cutting surface is positioned between two higher cutting surfaces, and planes in which the surfaces are disposed are parallel or, in other embodiments, are not parallel. The higher cutting surfaces may be at the same or different heights. In another aspect, a higher cutting surface is positioned between two lower cutting surfaces, and planes in which the surfaces are disposed are parallel or, in other embodiments, are not parallel. The lower cutting surfaces may be at the same or different heights. Any cutting surface of any of the above-described inserts may have one or more chipbreakers (irregularity, recess, indentation) for limiting the length of cuttings. By providing cutting surfaces at different heights, cuttings are sheared into multiple streams; i.e., rather than producing a single relatively wide cutting, the insert produces narrower cuttings, one for each cutting surface. In certain embodiments the body of the insert is, as viewed from above or below, generally circular, square, oval, rectangular, or triangular in shape.

In certain preferred embodiments of inserts according to this invention, insert height is limited to maintain insert strength. For example, in one embodiment a lowest cutting surface is at a height of no lower than about three sixteenths of an inch. In another aspect, an insert's height does not exceed about one-fourth of an inch.

In certain embodiments a multi-level insert according to this invention has no chipbreakers. In other embodiments a plurality of chipbreakers are so sized and so positioned on a multi-level insert that two (or more) cutting surfaces at angles to each other each produce a cutting stream and the cutting produced are limited in length by the chipbreakers. In one particular embodiment such a chipbreaker has an indented circular or oval shape (as viewed from above). In certain embodiments a patterned array of chipbreakers are employed covering an entire surface of the insert.

Inserts as described herein may be used on the various types of mills used in wellbore operations to mill out a fish or to produce a milled window or hole in a tubular such as casing or tubing.

In certain embodiments the present invention discloses a cutting insert for a tool for wellbore milling operations, the cutting insert having a body having a base, and a plurality of cutting surfaces on the body, at least one of the cutting surfaces at a different height above the base than the other cutting surfaces, each cutting surface defined by linear boundaries extending from a first edge of the cutting insert to a second edge of the cutting insert, and the linear boundaries parallel to each other as viewed from above; such an insert with a plurality of chipbreaking indentations on each cutting surface; such an insert wherein the plurality of cutting surfaces is three cutting surfaces including a first side cutting surface, a second middle cutting surface, and a third side cutting surface with the second middle cutting surface disposed between the first side cutting surface and the third side cutting surface; and such an insert wherein the body has a rectangular base and a raised portion extending above the rectangular base and the cutting surfaces are on a top of the raised portion The present invention also discloses a tool for wellbore milling operations having a mill body; at least one milling surface on the mill body; a plurality of cutting inserts secured to the at least one milling surface of the mill body; the cutting inserts each comprising a body having a base, and a plurality of cutting surfaces on the body, at least one of the cutting surfaces at a different height above the base than the other cutting surfaces, each cutting surface defined by linear boundaries extending from a first edge of the cutting insert to a second edge of the cutting insert, and the linear boundaries parallel to each other as viewed from above; and such a tool with a plurality of chipbreaking indentations on each cutting surface, and wherein the plurality of chipbreaking indentations is a patterned array of rows and columns of indentations covering the entire cutting surfaces.

The present invention, in certain embodiments, discloses a cutting insert for a tool for wellbore milling operations, the cutting insert having a body having a top, a bottom, and a base, and a plurality of cutting surfaces on the top of the body, one of the cutting surfaces at a different height above the base than the other cutting surface, each cutting surface defined by linear boundaries extending from a first edge of the cutting insert, and the linear boundaries parallel to each other, the plurality of cutting surfaces comprising at least two cutting surfaces including at least a first cutting surface and a second cutting surface, the second cutting surface at a height above the base which is greater than a height above the base of the first cutting surface; such a cutting insert wherein the second cutting surface is between about 0.03" and about 0.09" higher above the base than the first cutting surface; such a cutting insert with at least one chipbreaking indentation on each cutting surface; such a cutting insert wherein the base is rectangular having four sides; such a cutting insert with at least one tab projecting from the base for interlinking the cutting insert with another insert; such a cutting insert with at least one tab projecting from the base for spacing apart the cutting insert from another insert; such a cutting insert wherein the base is polygonal with multiple sides and a tab projects from each of at least two sides thereof; such a cutting insert with at least one tab receiving recess extending from an exterior surface of the base inwardly therein; any such cutting insert with a step member projecting from the base; any such cutting insert with a step member receiving recess extending from an exterior surface of the base inwardly therein; any such cutting insert with a step member projecting from the base, and with at least one chipbreaking indentation on the step member; any such cutting insert with the base having an end that tapers inwardly from the top of the body to the bottom thereof; any such cutting insert with the base having an end that tapers outwardly from the top of the body to the bottom thereof; any such insert wherein the bottom of the base tapers from a first side of the body to a second side thereof.

The present invention, in certain embodiments, discloses a cutting insert for a tool for wellbore milling operations, the cutting insert having a body having a top, a bottom, and a base, and a plurality of cutting surfaces on the top of the body, at least one of the cutting surfaces at a different height above the base than the other cutting surfaces, each cutting surface defined by linear boundaries extending from a first edge of the cutting insert to a second edge of the cutting insert, and the linear boundaries parallel to each other, the plurality of cutting surfaces comprising four cutting adjacent surfaces disposed side-by-side including a first cutting surface, a second cutting surface, a third cutting surface, and a fourth cutting surface, and at least two of the cutting surfaces at a substantially same height above the base; such a cutting insert with at least one chipbreaking indentation on each cutting surface; such an insert wherein the second cutting surface is disposed between the first and third cutting surfaces, the third cutting surface is disposed between the second and fourth cutting surfaces, the first and third cutting surfaces are at a substantially same height above the base, and the second and fourth cutting surfaces are at a substantially same height above the base different from that of the first and third cutting surfaces.

The present invention, in certain embodiments, discloses an array of cutting inserts with a plurality of adjacent inserts, each insert with interlinking apparatus comprising a projection on each of a first portion of the inserts and a projection recess on each of a second portion of the inserts, and the inserts arranged so that a projection on one insert is positioned in a projection recess of an adjacent insert.

The present invention, in certain embodiments, discloses a tool for wellbore milling operations, the tool having a mill body, at least one milling surface on the mill body, a plurality of cutting inserts secured to the at least one milling surface of the mill body, the cutting inserts each having a body having a base, at least two cutting surfaces on the body including at least a first cutting surface and a second cutting surface, the first cutting surface at a different height above the base than the second cutting surface, each cutting surface defined by linear boundaries extending from a first edge of the cutting insert to a second edge of the cutting insert, and the linear boundaries parallel to each other as viewed from above; and such a tool with at least one chipbreaking indentation on each cutting surface of each insert.

It is, therefore, an object of at least certain preferred embodiments of the present invention to provide:

- New, useful, unique, efficient, non-obvious inserts for wellbore milling tools, tools with such inserts, and methods for milling operations using such tools and such inserts;
- Such an insert with multi-level cutting surfaces;
- Such an insert with a plurality of chipbreakers; in one aspect chipbreakers with a circular or oval shape as viewed from above; in one aspect an array of such chipbreakers substantially covering the milling surface of an insert;
- Such an insert with plural cutting surfaces at angles to each other;
- An insert with two cutting surfaces at different levels;
- An insert with one or more projections for mating with a corresponding insert with one or more recesses for spacing apart the inserts and/or for interlinking them in an array;
- A milling tool with such an insert; and
- Methods for using such inserts and such tools in wellbore milling operations.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 2F is a cross-sectional view of a chipbreaker in a central portion of the insert as shown in FIG. 2D; FIG. 2G is a cross-sectional view of a chipbreaker in a side portion of the insert as shown in FIG. 2D; and FIG. 2H is a cross-sectional view along line 2H—2H of FIG. 2E.

FIG. 3A is a perspective view of an insert for wellbore milling according to the present invention; FIG. 3B is a top view of the insert of FIG. 3A.

FIG. 5A is a perspective view of a milling insert.

FIG. 5B is a perspective view of a milling insert shown producing multiple cuttings from a casing.

FIG. 8 shows a wellbore milling tool with inserts according to the present invention.

FIG. 9 shows a wellbore milling tool with inserts according to the present invention.

FIG. 10 is a perspective view of an insert array according to the present invention.

DESCRIPTION OF EMBODIMENTS PREFERRED AT THE TIME OF FILING FOR THIS PATENT

Figure 1A:
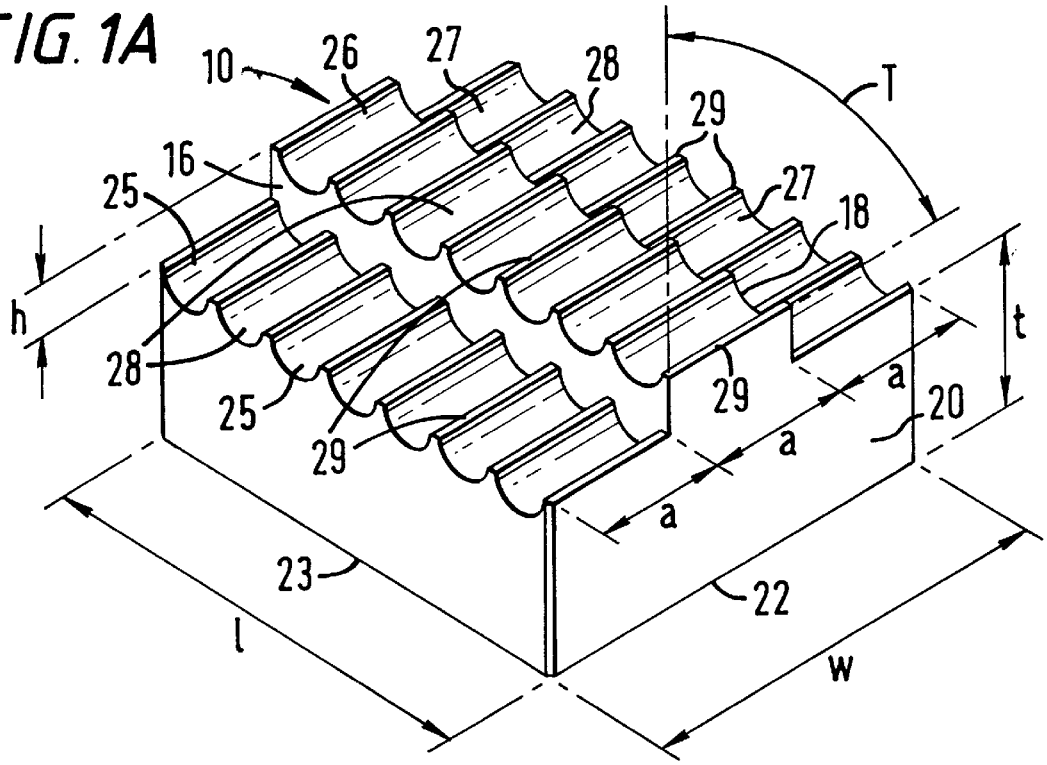
FIG. 1A is a perspective view of a wellbore milling insert according to the present invention.
Figure 1B:
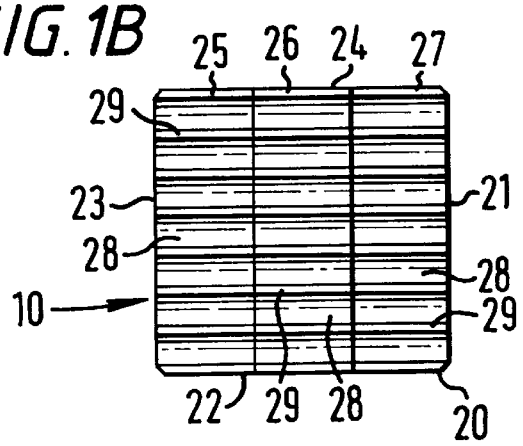
FIG. 1B is a top view of the insert of FIG. 1A.

Referring now to FIGS. 1A–1F, an insert 10 according to the present invention has a body 20 with four sides 21, 22, 23, 24. The body 20 is shown as square, but it may be rectangular, circular, oval, triangular or any desired shape. A top surface of the body 20 has three milling surfaces 25, 26, and 27. The surfaces 25 and 27 have a height t as shown in FIG. 1A. The surface 26 (disposed between the surfaces 25 and 27) has a height t+h as shown in FIG. 1A. Each top surface 25, 26, 27 has a plurality of chipbreaker indentations 28 formed therein with a ridge 29 between chipbreakers. As viewed from the side the side 21 is like the side 23.

The body 20 has a width w and a length l (equal to each other in the square embodiment of FIG. 1A). Each of the top surfaces 25, 26, 27 has a width a, three times which equals the width w. Sides 16 and 18 of the middle top surface 26 extend upwardly from the lower surfaces 25 and 27. It is within the scope of this invention for the three surfaces to have different widths or for any two of the surfaces to have the same width (either less than or greater than the third surface's width).

In certain preferred embodiments t+h ranges between about 3/16" and about 1/4"; and h ranges between about 0.03" and about 0.09". In one embodiment l and w are about 0.5"; t is about 0.187"; a is about 0.166"; and h is about 0.06". T is the angle between the surface of the ridges 29 and the sides of the top surface 26. In certain preferred embodiments T is ninety degrees or between eighty and ninety degrees. In certain preferred embodiments of such inserts, or tools with such inserts, cuttings are produced which range in thickness between about 0.015" and about 0.025", in length between about 0.5" and about 1.5"; and in width between about 0.125" and about 0.170". In one embodiment cuttings about 0.015" thick, about 0.170" wide, and about 1.5" long are produced.

Figure 1C:
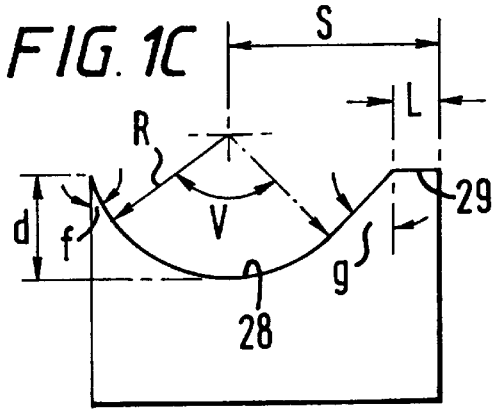
FIG. 1C is a partial side view of the insert of FIG. 1A.
Figure 1D:
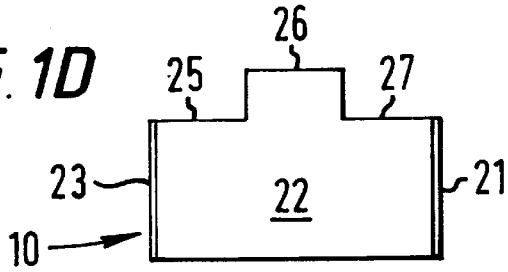
FIG. 1D is a front view of the insert of FIG. 1A.
Figure 1E:
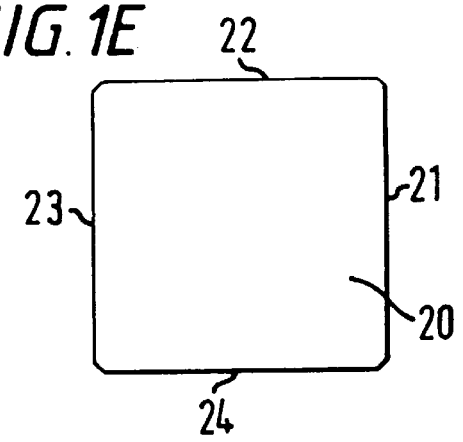
FIG. 1E is a bottom view of the insert of FIG. 1A.
Figure 1F:
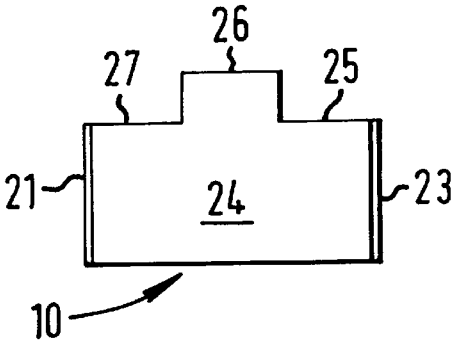
FIG. 1F is a rear view of the insert of FIG. 1A.

FIG. 1C shows one of the chipbreaker indentations 28 and ridges 29. S is a distance from an edge of the ridge 29 to a center of the indentation 28. L is the width of the ridge 29. d is the depth of the indentation 28. f is an angle between a portion of the indentation 28 and a vertical line drawn from an edge of a ridge 29 (not shown in FIG. 1C). g is an angle between a portion of the indentation 28 and a vertical line drawn through the inner edge of the ridge 29 (FIG. 1C). R is a radius of curvature of the angle V. V is an angle between ninety and one hundred and ten degrees.

In one preferred embodiment L ranges between 0.005" and 0.015". In one particular embodiment L is 0.01"; V is 102 degrees; f is 33 degrees; g is 45 degrees; R is 0.03"; S is 0.044"; and d is 0.022".

Figure 2A:
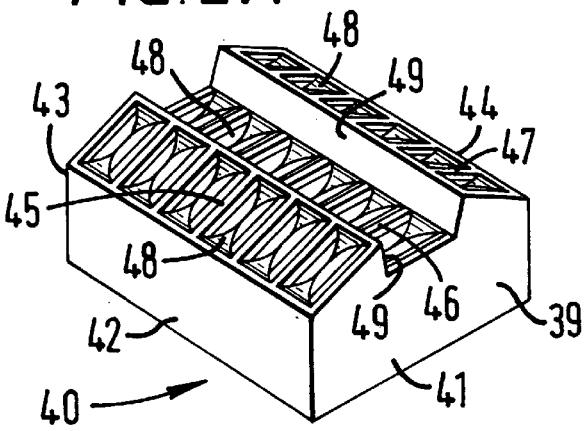
FIG. 2A is a perspective view of a wellbore milling insert according to the present invention.
Figure 2C:
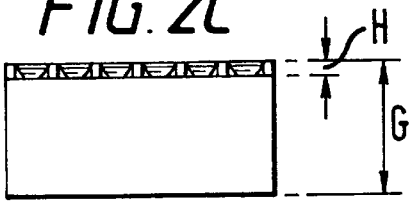
FIG. 2C is a side view of the insert of FIG. 2B.
Figure 2D:
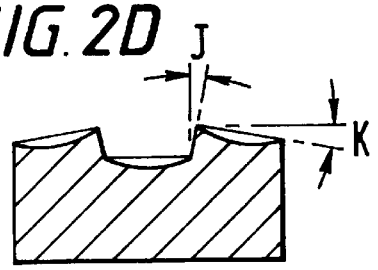
FIG. 2D is a cross-sectional view along line 2D—2D of FIG. 2B.

FIG. 2A shows an insert 40 according to the present invention which has a body 49; four sides 41, 42, 43, 44; top milling surfaces 45, 46, and 47; and a plurality of chipbreaking indentations 48. Angled interior side walls 39 in middle of the insert 40 extend from one of the side upper surfaces down to the lower middle surface 46.

In certain embodiments of the insert 40 (FIGS. 2A–2H) the labelled features have the following preferred dimensional ranges:

A 3/2" to ½"
B 0.25" to 0.335"
C 0.125" to 0.167"
D 3/16" to ¾"
E 0.06" to 0.115"
F 0.005" to 0.020"
G 3/16" to ¼"
H 0.030" to 0.090"
K 0° to 10°
L 0° to 45°
M 0° to 45°
N 0" to 0.2"
P 0° to 45°
Q 25° to 45°
R 0.02" to 0.04"
S 0° to 45°
T 0° to 45°
V 0° to 45°
W 0" to 0.2"

Letters N, W, R, in FIGS. 2F, 2G, 2H, respectively indicate radii of chipbreaking recesses.

As shown in FIG. 2A the insert 40 has the three cutting surfaces 45, 46, and 47 which are defined by linear boundaries running from one edge of the insert to another edge of the insert. The cutting surfaces each lie in a plane and the planes as shown are not coincident. The planes of the outside cutting surfaces 45 and 47 are at angle to the plane of the middle cutting surface 46 which is greater than 180°. The streams of cuttings produced by the two outside cutting surfaces 45 and 47 will diverge from the cuttings stream produced by the middle cutting surface 46. In another embodiment the angle of the outside planes with respect to the middle plane is less than 180° and the streams of cuttings produced by the outside cutting surfaces will converge on and be directed toward the cuttings stream produced by the middle cutting surface. It is within the scope of this invention to provide an insert with only two cutting surfaces (e.g. any two of the cutting surfaces of any insert shown or described herein).

Figure 3C:
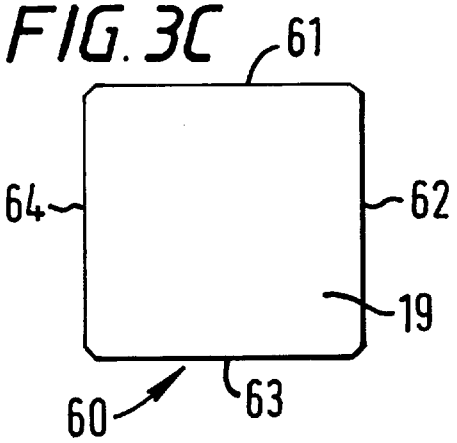
FIG. 3C is a bottom view of the insert of FIG. 3A.
Figure 3D:
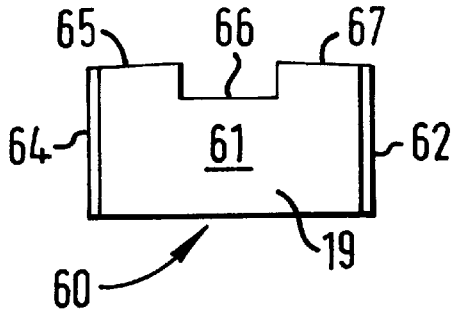
FIG. 3D is a front view of the insert of FIG. 3A.
Figure 3E:
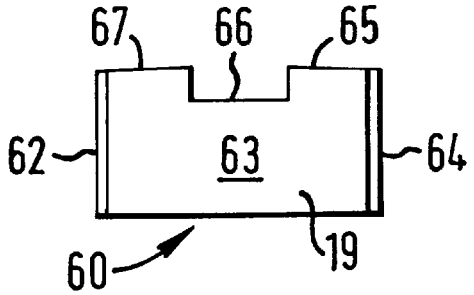
FIG. 3E is a rear view of the insert of FIG. 3A.

FIG. 3A shows an insert 60 according to the present which has a body 19; four sides 61, 62, 63, 64; top milling surfaces 65, 66, and 67; and a plurality of chipbreaking indentations 68 with ridges 69 therebetween. The two sides of the insert 60, one shown in FIG. 3A, look the same.

Figure 4A:
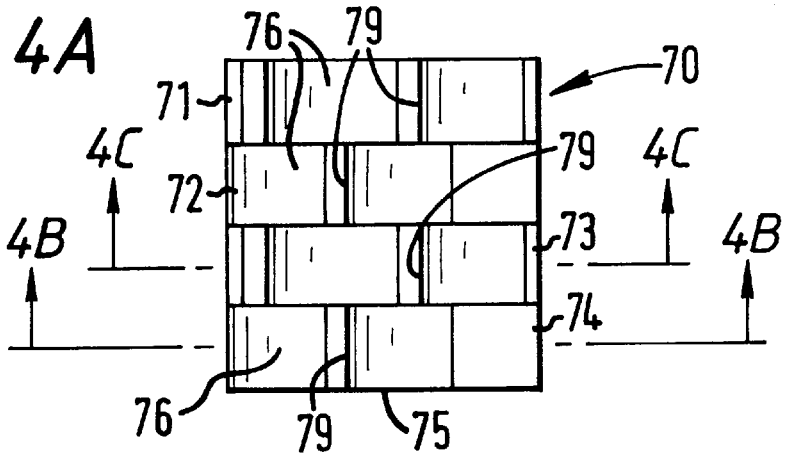
FIG. 4A is a top view of a wellbore milling insert.
Figure 4B:
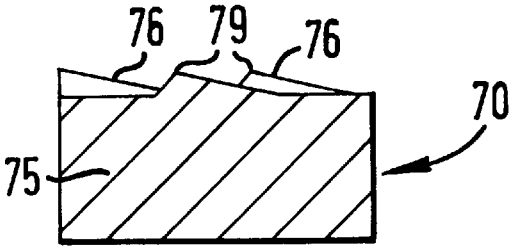
FIG. 4B is a cross-sectional view along line 4B—4B of FIG. 4A.
Figure 4C:
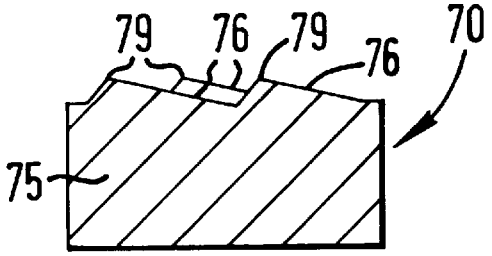
FIG. 4C is a cross-sectional view along line 4C—4C of FIG. 4A.

FIGS. 4A–4C shows an insert 70 with a four sides body 75 with a plurality of top ramps 76 in rows 71, 72, 73, and 74. Peaks 79 of ramps in one row are offset from those in another row.

FIGS. 5A and 5B show inserts 80 and 81 designed by Mr. Robert Taylor and co-owned with the present invention. The insert 80 has a plurality of criss-crossing ridges 82, 83 between which are formed chipbreakers 84. The insert 81 has a plurality of criss-crossing ridges 85, 86 between which are formed chipbreakers 87. As shown in FIG. 5B the insert 81 cuts a casing 88 to form three cuttings 89.

Figure 6A:
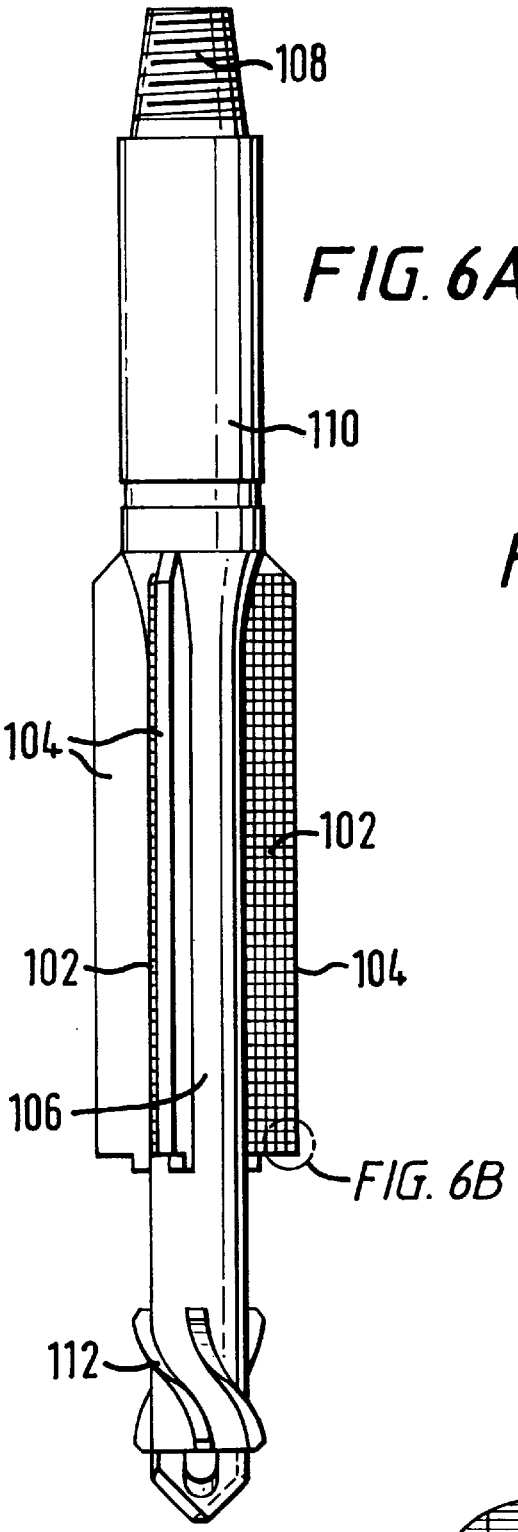
FIG. 6A shows a wellbore milling tool with inserts according to the present invention.
Figure 6B:
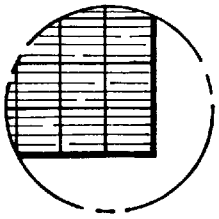
FIG. 6B shows an enlarged portion of the tool of FIG. 6A.

FIG. 6A and 6B show a pilot mill 110 according to the present invention which is like a prior art A-1 TDS Pilot Mill; but with inserts 102 according to the present invention (like any insert described and/or claimed herein) on blades 104 on a mill body 106 with an upper threaded end 108 and a lower pilot mill end 112.

Figure 7:
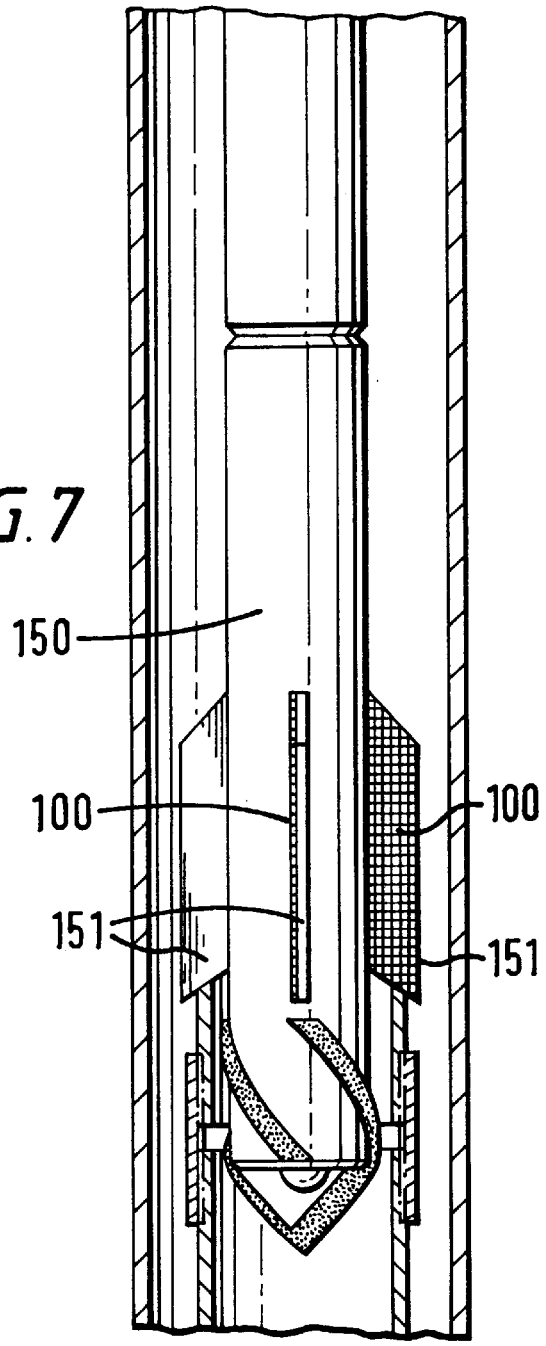
FIG. 7 shows a wellbore milling tool with inserts according to the present invention.

FIG. 7 shows a pilot mill 150 according to the present invention (e.g. similar to that as referred to in U.S. Pat. No. 4,984,488) with inserts 100 according to the present invention (like any insert described and/or claimed herein) on blades 151 thereof. Such inserts may also be used on the bottom ends of the mills shown in FIG. 6A and in FIG. 7.

Filed on even date herewith and co-owned with the present invention are the applications entitled "Section Milling" U.S. application Ser. No. 532,473 filed Sep. 22, 1995, issued as U.S. Pat. No. 5,642,787 on Jul. 1, 1997 naming Hutchinson as inventor and entitled "Wellbore Sidetracking Methods And Apparatuses" U.S. application Ser. No. 532,180 filed Sep. 22, 1995, issued as U.S. Pat. No. 5,584,350 on Dec. 17, 1996 naming Schnitker et al as inventors which are both incorporated fully herein for all purposes.

Figure 2B:
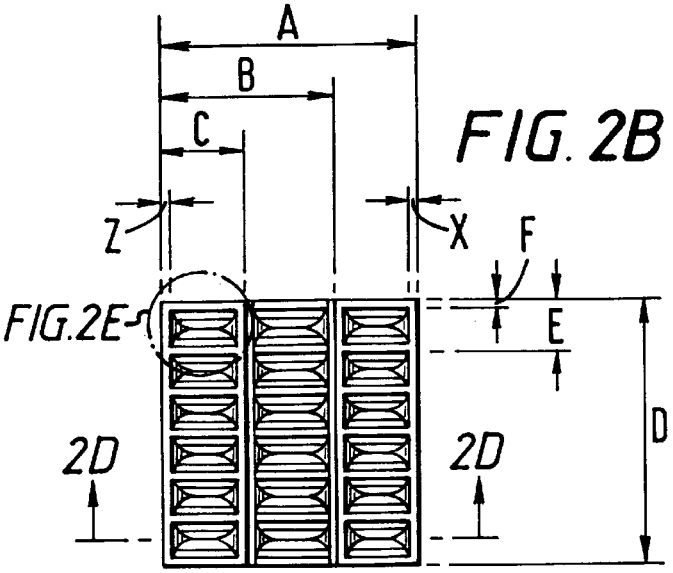
FIG. 2B is a top view of the insert of FIG. 2A (the bottom view is a plain square)
Figure 2E:
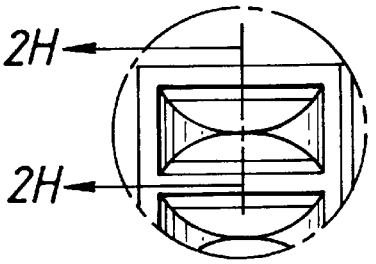
FIG. 2E is an enlargement of a portion of the insert shown in FIG. 2B.

FIG. 8 shows an insert 200 according to the present invention with a base 205 and an upper milling surface that has an array of chipbreaker indentations 202 (like the array in FIG. 2B; like the indentations in FIGS. 1A and 1C). The base 205 when viewed from below is like the top view of FIG. 8, but without any indentations.

FIG. 9 shows an insert 250 according to the present invention with a circular base 255 and three top milling surfaces 256, 257, and 258. The milling surfaces each are covered with chipbreaker indentations 252 separated by ridges 259.

FIG. 10 shows a blade B (or mill body portion) with three inserts aligned thereon. An insert 60 is flanked by two inserts 10. Such a series of inserts may be applied to any mill blade or any mill body and additional rows like the row of FIG. 10 may be placed one above the other and/or one next to the other.

Figure 11:
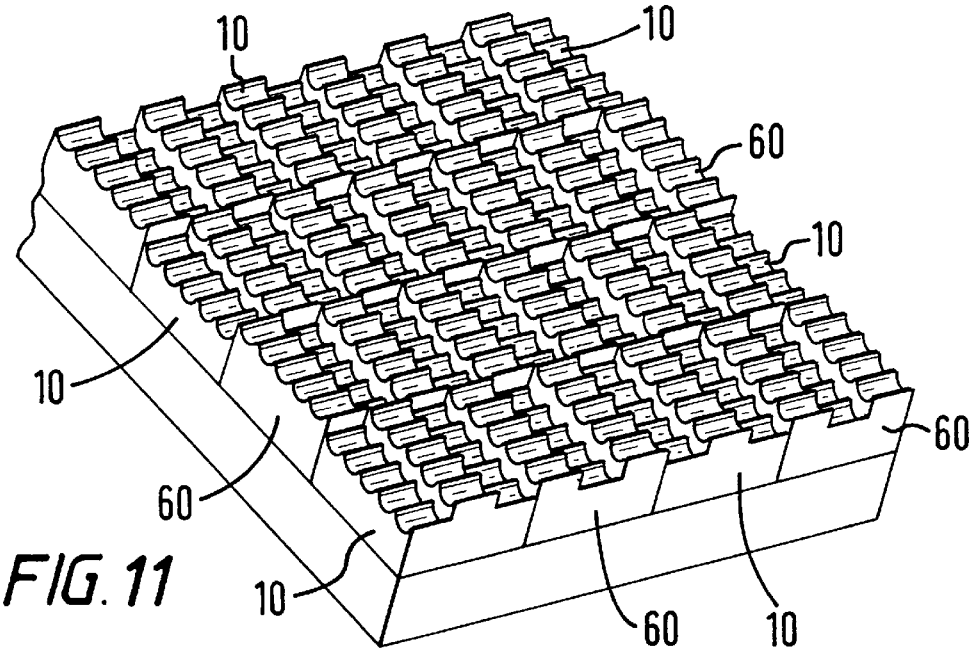
FIG. 11 is a perspective view of an insert array according to the present invention.

FIG. 11 shows a blade L (or mill body portion) with a layer of alternating inserts 10 and 60. The pattern may be extended in any direction to include additional inserts 10 and 60. Alternatively it may include only inserts 10 or only inserts 60 (or any insert disclosed herein or combination thereof).

Figure 12A:
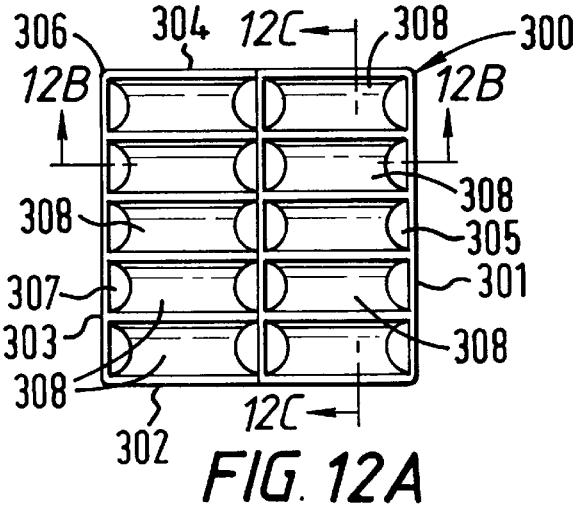
FIG. 12A is a top view of an insert according to the present invention.
Figure 12C:
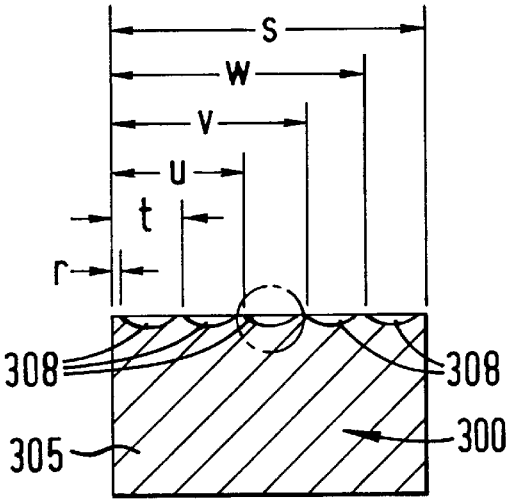
FIG. 12C is a cross-section view along line 12C—12C of FIG. 12A.
Figure 12B:
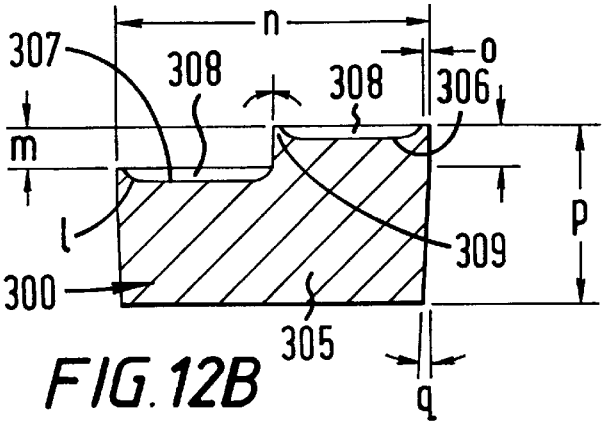
FIG. 12B is a cross-section view along line 12B—12B of FIG. 12A.
Figure 12D:
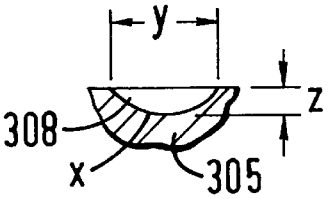
FIG. 12D is a detail view of the encircled part of FIG. 12C.

FIGS. 12A–12C shows an insert 300 with a body 305 and four sides 301, 302, 303, and 304. The body 305 is shown as square with rounded corners (as viewed from above), but it may be any desired shape, e.g. rectangular, circular, oval, elliptical, triangular, trapezoidal or any desired shape (as may the inserts of FIGS. 1A–9). A top surface of the body 305 has two milling surfaces 306 and 307, each of which has a plurality of chip breaker indentations 308 formed therein with ridges 309 therebetween.

In one particular embodiment, the insert 300 has these dimensions in inches:

| | | | |
|---|---|---|---|
| m .05 | p .218 | t .083 | w. 302 |
| n .375 | r .01 | u .156 | y .063 |
| o .005 | s .375 | v .229 | z .015 |

The angle q is about 1.8 degrees; the radius at x is about 0.04 inches; and the radius l is about 0.03 inches.

FIGS. 13A–13D show an insert 320 according to the present invention with a body 325 and four sides 321, 322, 323, and 324. The body 325 is shown as rectangular with rounded corners, (as viewed from above), but it may be any desired shape, e.g. square, circular, oval, elliptical, triangular, or trapezoidal. A top surface of the body 325 has two milling surfaces 326 and 327 each with a plurality of chipbreakers 328 formed therein with ridges 329 therebetween.

One particular embodiment of an insert 320 has the following dimensions in inches:

| | | | | |
|---|---|---|---|---|
| E .04 | H .083 | K .302 | N .521 | Q .063 |
| F .3383 | I .156 | L .375 | O .015 | R .005 |
| G .01 | J .229 | M .448 | P .2425 | |

The angles noted are as follows, in degrees:

| | | | | |
|---|---|---|---|---|
| S 1.3 | T 3.7 | U 11.3 | V 91.3 | W 40 |

The radiuses noted are as follows, in inches:

| | | |
|---|---|---|
| X .04 | Y .01 | Z .03 |

Figure 13A:
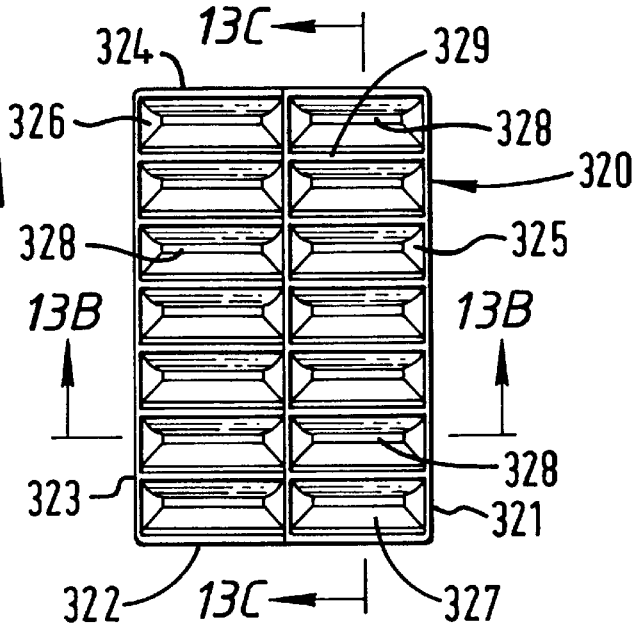
FIG. 13A is a top view of an insert according to the present invention.
Figure 13B:
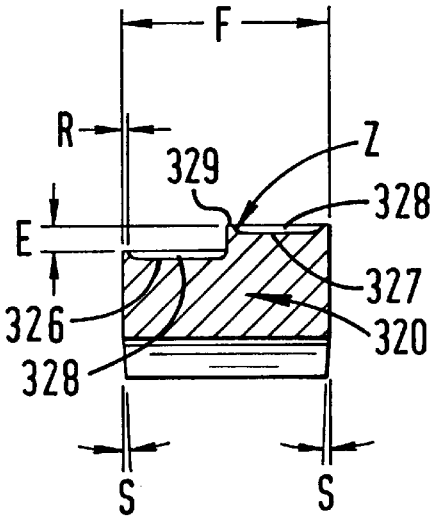
FIG. 13B is a cross-section view along line 13B—13B of FIG. 13A.
Figure 13C:
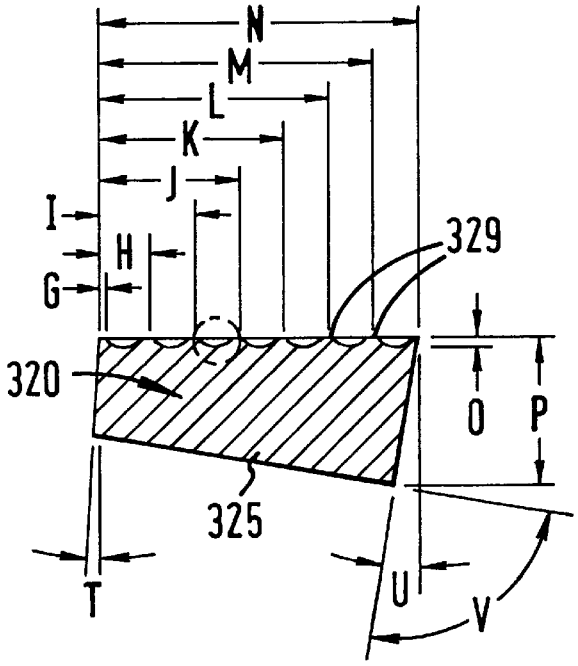
FIG. 13C is a cross-section view along line 13C—13C of FIG. 13A.
Figure 13D:
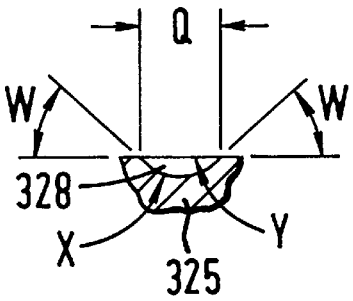
FIG. 13D is a detail view of the encircled part of FIG. 13C.

Corner radiuses (as viewed from above) are, in certain preferred embodiments 0.15 or 0.005 inches. As shown in FIG. 13C, the bottom of the insert 320 is tapered from one side to the other.

Figure 14A:
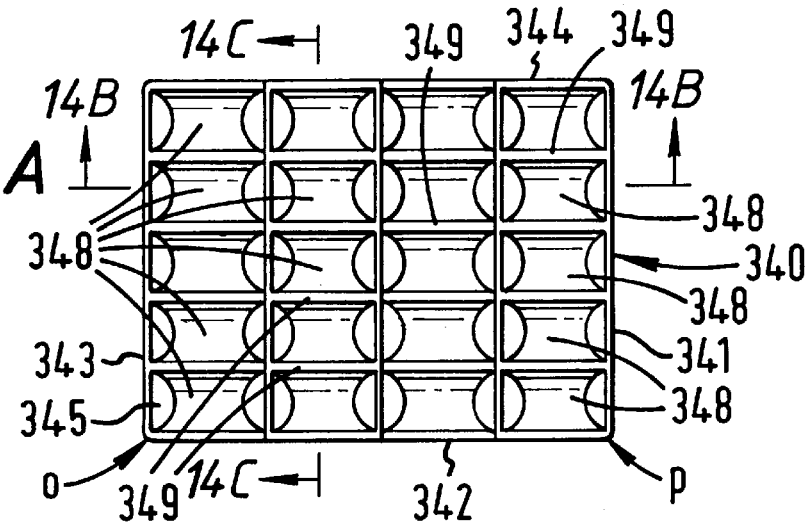
FIG. 14A is a top view of an insert according to the present invention.
Figure 14B:
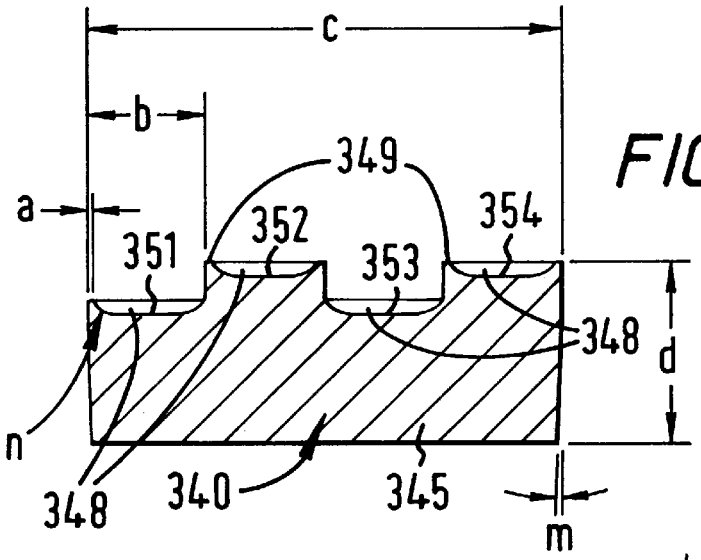
FIG. 14B is a cross-section view along line 14B—14B of FIG. 14A.
Figure 14C:
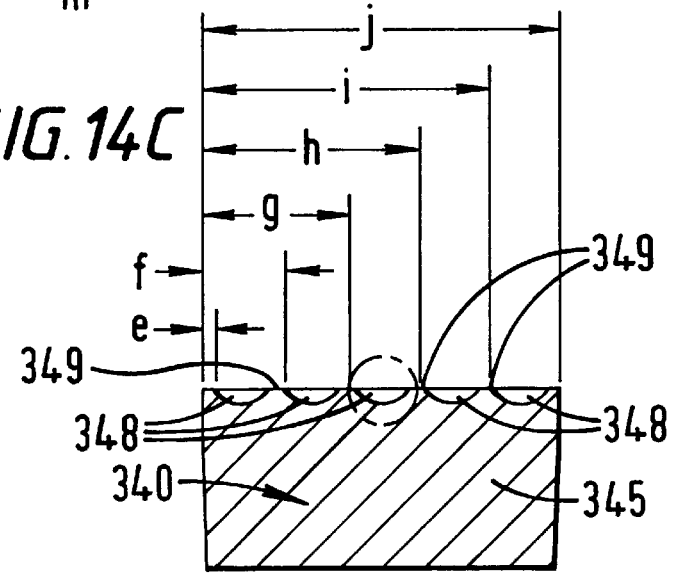
FIG. 14C is a cross-section view along line 14C—14C of FIG. 14A.
Figure 14D:
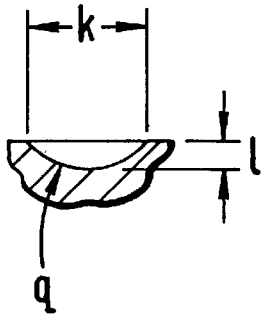
FIG. 14D is a detail view of the encircled part of FIG. 14C.

FIGS. 14A–14C show an insert 340 according to the present invention with a body 345 and four sides 341, 342, 343, and 344 As with the inserts described above, the inserts 340 shown from above as rectangular, may be any desired shape. A top surface of the body 345 has four milling surfaces 351, 352, 353, and 354 each with a plurality of chipbreakers 348 formed therein with ridges 349 therebetween.

One particular embodiment of the insert 340 has the following dimensions in inches:

| | | | |
|---|---|---|---|
| a .005 | d .188 | g .156 | j .375 |
| b .125 | e .01 | h .229 | k .063 |
| c .5 | f .083 | i .302 | 1 .015 |

The angular dimension m is about 1.8 degrees and the radiuses in inches are:

| | | | |
|---|---|---|---|
| n .03 | o .005 | p .015 | q .04 |

Figure 15A:
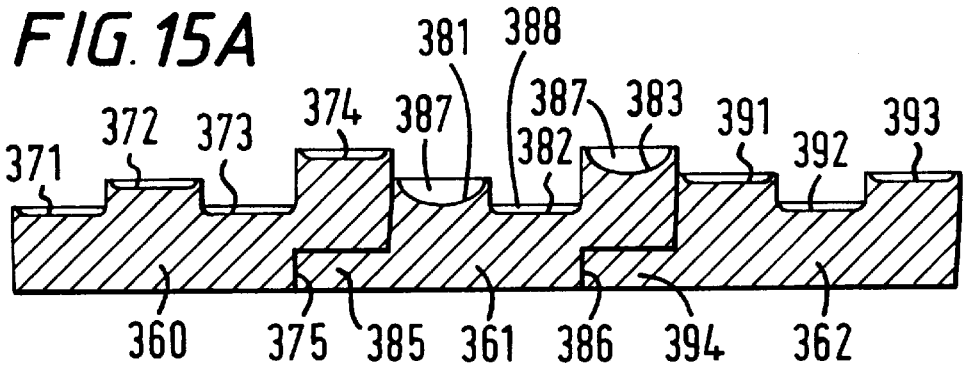
FIG. 15A is a side view of an insert array according to the present invention.

FIG. 15A shows inserts 360, 361, and 362 in an array according to the present invention the top views of the inserts 361 and 362 are similar to that of FIG. 14A with one milling surface deleted, but with a step member or a recess which the insert of FIG. 14A does not have; and that of the insert 360 is like that of the insert 340.

The insert 360 has four top milling surfaces 371, 372, 373, 374 and a step receiving recess 375. The insert 361 has three top milling surfaces 381, 382, 383, and 384 each with a chipbreaker indentation; a step member 385; and a step receiving recess 386. The insert 361 has different depth chipbreakers 387 and 388 in its milling surfaces and all milling surfaces are at different levels. The step member 385 is positioned in the step receiving recess 375 of the insert 360. The milling insert 362 has three milling surfaces 391, 392, 393 each with a chipbreaker indentation and a step member 394 that is positioned in the step receiving recess 386 of the insert 361. The insert 361 may be deleted from the pattern of FIG. 15. Alternatively, multiple inserts 361 may be used.

It is within the scope of this invention to provide a step member on any insert and a step receiving recess on any insert. It is within the scope of this invention for the step member to be at any level on the insert (as viewed from the side in FIG. 15); to be on any side of the insert; and for a step receiving recess to be anywhere on an insert suitable for positioning therein of a step member. Also the extent of the step (side-to-side in FIG. 15) may be any desired length with a corresponding step receiving recess. The step members may extend across the entire width of an insert or only partially across. Any step member may have a chipbreaking indentation or part thereof.

Figure 15B:
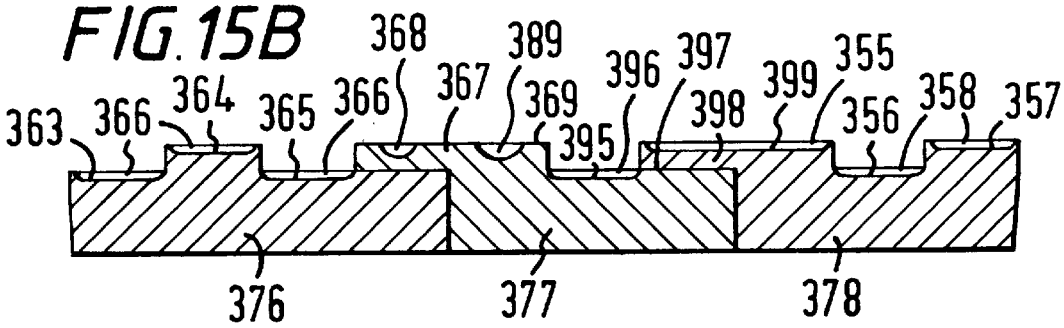
FIG. 15B is a side view of an insert array according to the present invention.

FIG. 15B shows inserts 376, 377 and 378 in an array according to the present invention. The insert 376 has milling surfaces 363, 364, and 365 each with a chipbreaker 366. The insert 377 has a step member 367 with a chipbreaker indentation 368; a milling surface 369 with a chipbreaker indentation 389; a milling surface 395 with a chipbreaker indentation 396; and a step surface 397 over which a step member is positionable. The insert 378 has a step member 398 that overlies the step surface 397; a milling surface 399; a chipbreaker 355 on the step member 398 and on the milling surface 399; a milling surface 356; a milling surface 357; and chipbreakers 358.

Figure 16A:
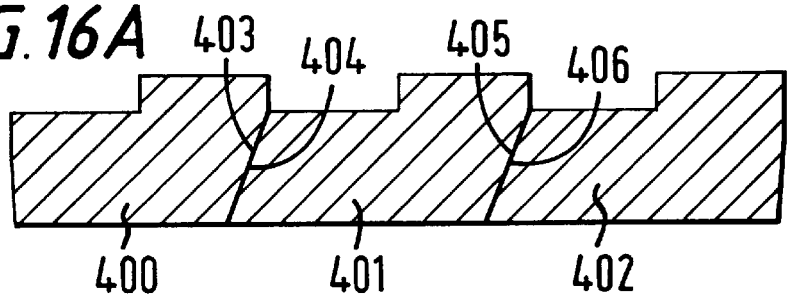
FIG. 16A is a side view of an insert array according to the present invention.

FIG. 16A shows (side view) an insert 400, an insert 401, and an insert 402, all according to the present invention. Each insert has two top milling surfaces. The insert 400 has a tapered or canted end 403. The insert 401 has a front end 404 that is angled to correspond to and be positioned under the canted end 403 of the insert 400. The insert 401 has a canted end 405. The insert 402 has a front end 406 that is angled to correspond to and be positioned under the end 405 of the insert 401. Each insert has two top milling surfaces, but it is within the scope of this invention for there to be one, three, four or more such surfaces with or without one or more chipbreakers.

Figure 16B:
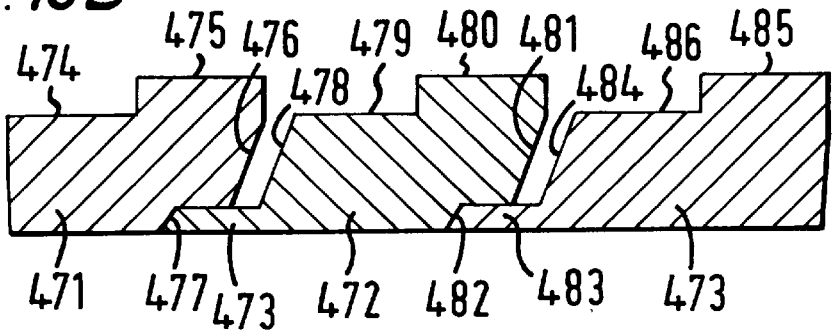
FIG. 16B is a side view of an insert array according to the present invention.

FIG. 16B shows inserts 471, 472 and 473 in an array according to the present invention. The insert 471 has a milling surface 474; a milling surface 475; a tapered end 476; and a step recess 477. The insert 472 has a step 473 part of which is in the step recess 477; a tapered end 478; a milling surface 479; a milling surface 480; a tapered end 481 and a step recess 482. The milling insert 473 has a step 483 part of which is in the step recess 482; a tapered end 484; a milling surface 488; and a milling surface 486. By appropriate sizing of the step recesses and the steps, the spacing between the inserts is determined (or abutment of two inserts). Except for the tapered end(s) and/or step members and recesses, the inserts of FIGS. 16A and 16B, in certain aspects, are like that of FIGS. 12A–12D. Inserts according to the present invention as in FIG. 16B may have one, three, four or more milling surfaces with or without one or more chipbreakers. With respect to the inserts of FIG. 16B (and any spaced-apart inserts disclosed herein) steps, recesses, and/or tabs may be used to achieve desired spacing and matrix material and/or milling matrix material may be emplaced in any space between inserts. Steps, tabs, and/or recesses may be used to achieve proper arrangement, alignment, and orientation (one insert with respect to another as well as various rake angles) of inserts on milling bodies or on milling blades. Inserts disclosed herein may be applied by any known application method in any known combination, pattern, array or arrangement.

Figure 17A:
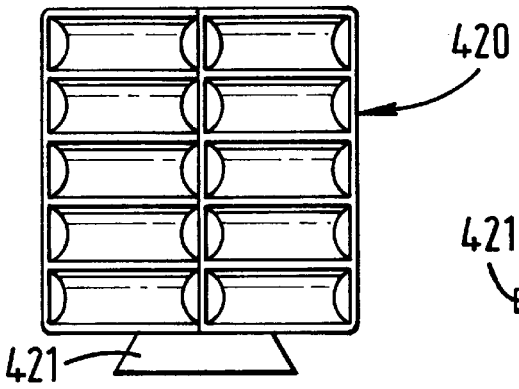
FIG. 17A is a top view of an insert according to the present invention.
Figure 17B:
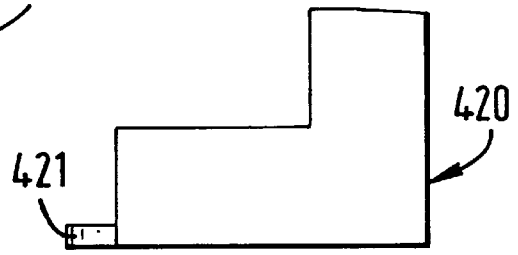
FIG. 17B is a side view of the insert of FIG. 17A.

FIGS. 17A and 17B show an insert 420 like the insert 300 described above, but with a positioning tab 421 projecting from one of its sides. The insert 420 with the tab 421 may be used with an insert like the insert 300 (or any insert disclosed herein) to space the insert 420 apart from another insert with the tab 421 abutting the other insert. Alternatively, the tab 421 may be positioned in a corresponding recess of another insert, either with a tight fit or a loose fit, depending on abutment or spacing desired between inserts.

Figure 17C:
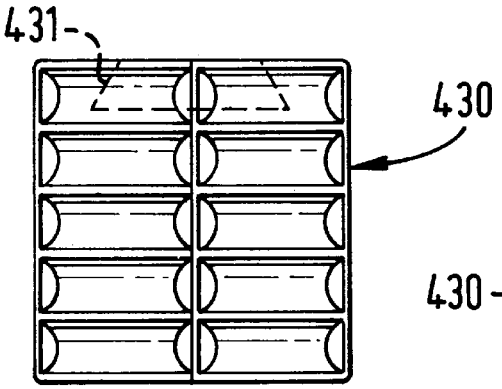
FIG. 17C is a top view of an insert according to the present invention.
Figure 17D:
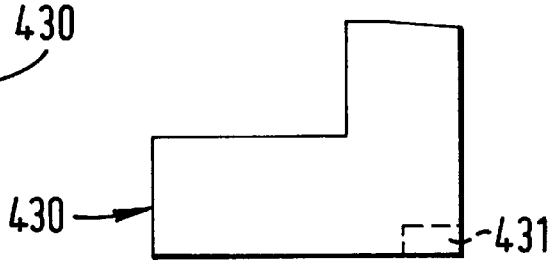
FIG. 17D is a cross-section view along line 17D—17D of FIG. 17C.
Figure 17E:
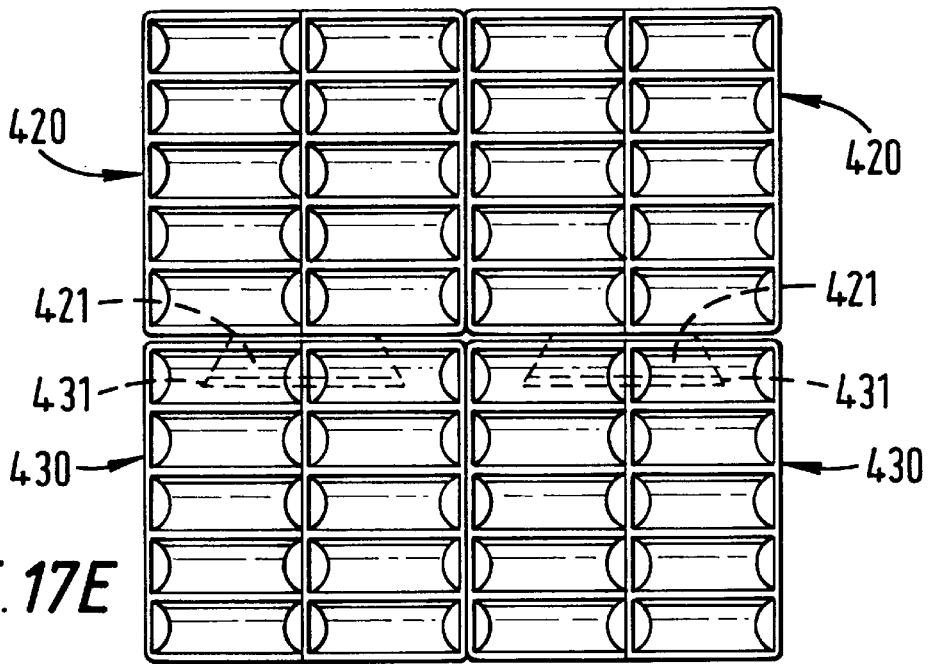
FIG. 17E is a top view of an array with inserts of FIGS. 17A—17D.

FIGS. 17C and 17D show an insert 430 like the insert 300 described above, but with a tab insert recess 431 for receiving a tab like the tab 421 of the insert 420. FIG. 17E shows an array of inserts 420 and 430

Figure 18A:
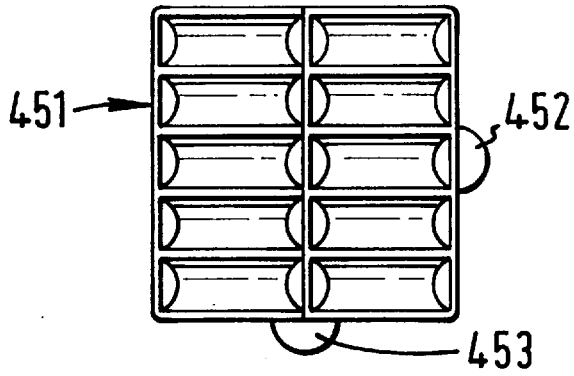
FIG. 18A is a top view of an insert array according to the present invention.
Figure 18B:
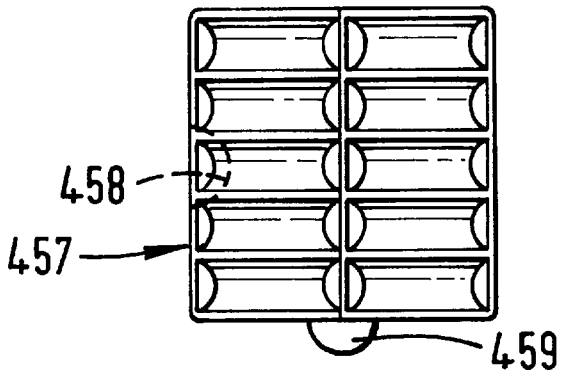
FIG. 18B is a top view of an insert array according to the present invention.
Figure 18C:
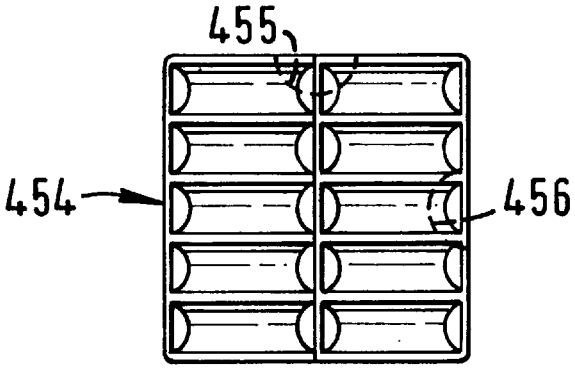
FIG. 18C is a top view of an insert according to the present invention.
Figure 18D:
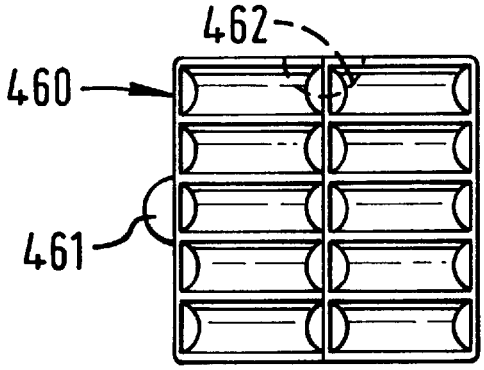
FIG. 18D is a top view of an insert according to the present invention.
Figure 18E:
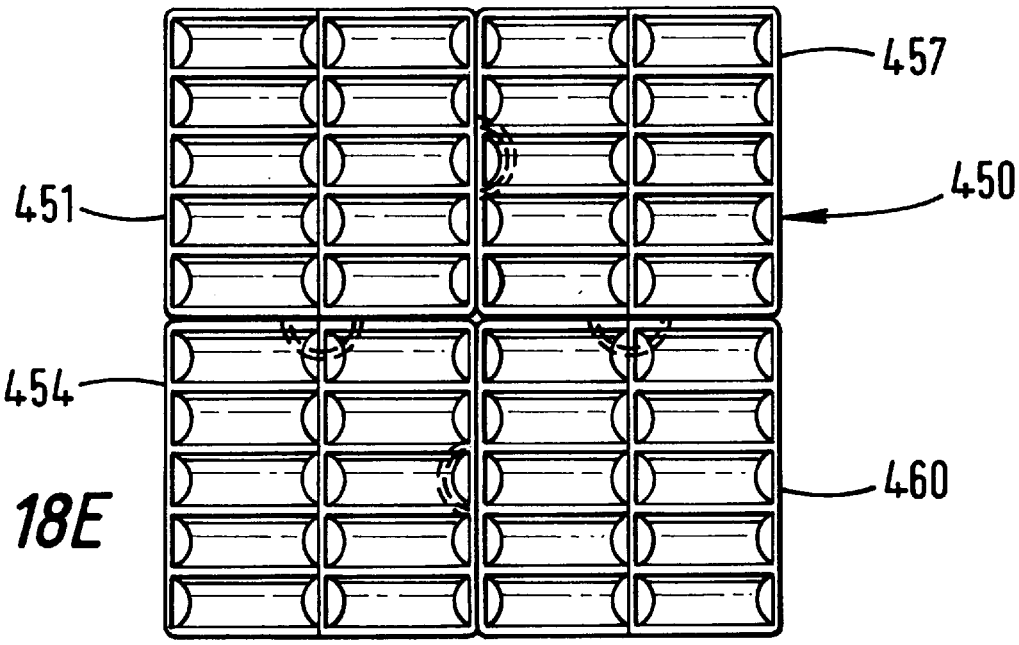
FIG. 18E is a top view of an insert according to the present invention.

It is within the scope of this invention to provide inserts with one or more steps or tabs of any desired shape (half circle, square, rectangular, triangular, half oval, trapezoidal, etc.) and inserts with recesses shaped to receive such steps or tabs or part thereof. It is within the scope of this invention to provide an insert with a step or tab on one, two, three or four sides (or for a non-straight sided insert to provide one or more steps or tabs on a curved surface thereof) and corresponding inserts with a corresponding recess or recesses. Thus, in one aspect, an array of interlinked inserts is provided, such as the array 450 of FIG. 18A that includes an insert 451 (FIG. 18B) with tabs 452 and 453; an insert 454 (FIG. 18C) with tab recesses 455, 456; an insert 457 (FIG. 18D) with a tab recess 458 and a tab 459; and an insert 460 (FIG. 18E) with a tab 461 and a tab recess 462. A minimum space is shown between inserts in the array 450, but any desired spacing may be employed or the inserts (or any pair of inserts or group) may abut each other. In certain embodiments a plurality of inserts are used adjacent each other and it is not desirable for the breaking of one insert to result in the breaking of an adjacent insert. It is within the scope of this invention to use a step or tab of such a thickness that it provides the desired interlinking and/or insert-to-insert spacing, but is sufficiently weak that the step or tab breaks in response to force on an adjacent insert without the breaking of the insert with the step or tab. In other aspects, the step or tab (instead of or in addition to reduced thickness) may have a weakening groove, cut, or indentation (which may or may not be one or more chipbreakers). For example, and without limitation, the chipbreaker indentation 368 of the step member 367 (FIG. 15B) may be of sufficient size to render the step member a "breakaway" member if force applied to the insert 376 is sufficient to break the insert 376.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A cutting insert for a tool for wellbore milling operations, the cutting insert comprising a body having a top, a bottom, and a base, and a plurality of cutting surfaces on the top of the body, at least one of the cutting surfaces at a different height above the base than the other cutting surfaces, each cutting surface defined by linear boundaries extending from a first edge of the cutting insert to a second edge of the cutting insert, and the linear boundaries parallel to each other, the plurality of cutting surfaces comprising four cutting adjacent surfaces disposed side-by-side including a first cutting surface, a second cutting surface, a third cutting surface, and a fourth cutting surface, and at least two of the cutting surfaces at a substantially same height above the base.

2. The cutting insert of claim 1 further comprising at least one chipbreaking indentation on each cutting surface.

3. The insert of claim wherein the second cutting surface is disposed between the first and third cutting surfaces, the third cutting surface is disposed between the second and fourth cutting surfaces, the first and third cutting surfaces are at a substantially same height above the base, and the second and fourth cutting surfaces are at a substantially same height above the base different from that of the first and third cutting surfaces.

4. A cutting insert for a tool for wellbore milling operations, the cutting insert comprising a body having a top, a bottom, and a base, and a plurality of cutting surfaces on the top of the body, one of the cutting surface at a different height above the base than the other cutting surface, each cutting surface defined by linear boundaries extending from a first edge of the cutting insert, and the linear boundaries parallel to each other, the plurality of cutting surfaces comprising at least two cutting surfaces including at least a first cutting surface and a second cutting surface, the second cutting surface at a height above the base which is greater than a height above the base of the first cutting surface, and the at least one tab projecting from the base for interlinking the cutting insert with another insert.

5. The cutting insert of claim 4 wherein the second cutting surface is between about 0.03" and about 0.09" higher above the base than the first cutting surface.

6. The cutting insert of claim 4 further comprising at least one chipbreaking indentation on each cutting surface.

7. The cutting insert of claim 4 wherein the base is rectangular having four sides.

8. A cutting insert for a tool for wellbore milling operations, the cutting insert comprising a body having a top, a bottom, and a base, and a plurality of cutting surfaces on the top of the body, one of the cutting surfaces at a different height above the base than the other cutting surface, each cutting surface defined by linear boundaries extending from a first edge of the cutting insert, and the linear boundaries parallel to each other, the plurality of cutting surfaces comprising at least two cutting surfaces including at least a first cutting surface and a second cutting surface, the second cutting surface at a height above the base which is greater than a height above the base of the first cutting surface, and at least one tab projecting from the base for spacing apart the cutting insert from another insert.

9. The cutting insert of claim 8 further comprising at least one chipbreaking indentation on each cutting surface.

10. A cutting insert for a tool for wellbore milling operations, the cutting insert comprising a body having a top, a bottom, and a base, and a plurality of cutting surfaces on the top of the body, one of the cutting surfaces at a different height above the base than the other cutting surface, each cutting surface defined by linear boundaries extending from a first edge of the cutting insert, and the linear boundaries parallel to each other, the plurality of cutting surfaces comprising at least two cutting surfaces including at least a first cutting surface and a second cutting surface, the second cutting surface at a height above the base which is greater than a height above the base of the first cutting surface, and wherein the base is polygonal with multiple sides and a tab projects from each of at least two sides thereof.

11. The cutting insert of claim 10 further comprising at least one chipbreaking indentation on each cutting surface.

12. A cutting insert for a tool for wellbore milling operations, the cutting insert comprising a body having a top, a bottom, and a base, and a plurality of cutting surfaces on the top of the body, one of the cutting surfaces at a different height above the base than the other cutting surface, each cutting surface defined by linear boundaries extending from a first edge of the cutting insert, and the linear boundaries parallel to each other, the plurality of cutting surfaces comprising at least two cutting surfaces including at least a first cutting surface and a second cutting surface, the second cutting surface at a height above the base which is greater than a height above the base of the first cutting surface, and at least one tab receiving recess extending from an exterior surface of the base inwardly therein.

13. The cutting insert of claim 12 further comprising at least one chipbreaking indentation on each cutting surface.

14. A cutting insert for a tool for wellbore milling operations, the cutting insert comprising a body having a top, a bottom, and a base, and a plurality of cutting surfaces on the top of the body, one of the cutting surfaces at a different height above the base than the other cutting surface, each cutting surface defined by linear boundaries extending from a first edge of the cutting insert, and the linear boundaries parallel to each other, the plurality of cutting surfaces comprising at least two cutting surfaces including at least a first cutting surface and a second cutting surface, the second cutting surface at a height above the base which is greater than a height above the base of the first cutting surface, and a step member projecting from the base.

15. The cutting insert of claim 14 further comprising at least one chipbreaking indentation on each cutting surface.

16. A cutting insert for a tool for wellbore milling operations, the cutting insert comprising a body having a top, a bottom, and a base, and a plurality of cutting surfaces on the top of the body, one of the cutting surfaces at a different height above the base than the other cutting surface, each cutting surface defined by linear boundaries extending from a first edge of the cutting insert, and the linear boundaries parallel to each other, the plurality of cutting surfaces comprising at least two cutting surfaces including at least a first cutting surface and a second cutting surface, the second cutting surface at a height above the base which is greater than a height above the base of the first cutting surface, and a step member receiving recess extending from an exterior surface of the base inwardly therein.

17. The cutting insert of claim 16 further comprising at least one chipbreaking indentation on each cutting surface.

18. A cutting insert for a tool for wellbore milling operations, the cutting insert comprising a body having a top, a bottom, and a base, and a plurality of cutting surfaces on the top of the body, one of the cutting surfaces at a different height above the base than the other cutting surface, each cutting surface defined by linear boundaries extending from a first edge of the cutting insert, and the linear boundaries parallel to each other, the plurality of cutting surfaces comprising at least two cutting surfaces including at least a first cutting surface and a second cutting surface, the second cutting surface at a height above the base which is greater than a height above the base of the first cutting surface, and a step member projecting from the base, and at least one chipbreaking indentation on the step member.

19. The cutting insert of claim 18 further comprising at least one chipbreaking indentation on each cutting surface.

20. A cutting insert for a tool for wellbore milling operations, the cutting insert comprising a body having a top, a bottom, and a base, and a plurality of cutting surfaces on the top of the body, one of the cutting surfaces at a different height above the base than the other cutting surface, each cutting surface defined by linear boundaries extending from a first edge of the cutting insert, and the linear boundaries parallel to each other, the plurality of cutting surfaces comprising at least two cutting surfaces including at least a first cutting surface and a second cutting surface, the second cutting surface at a height above the base which is greater than a height above the base of the first cutting surface, and the body having a side that tapers inwardly from the top of the body to the bottom thereof.

21. The cutting insert of claim 20 further comprising at least one chipbreaking indentation on each cutting surface.

22. A cutting insert for a tool for wellbore milling operations, the cutting insert comprising a body having a top, a bottom, and a base, and a plurality of cutting surfaces on the top of the body, one of the cutting surfaces at a different height above the base than the other cutting surface, each cutting surface defined by linear boundaries extending from a first edge of the cutting insert, and the linear boundaries parallel to each other, the plurality of cutting surfaces comprising at least two cutting surfaces including at least a first cutting surface and a second cutting surface, the second cutting surface at a height above the base which is greater than a height above the base of the first cutting surface, and the body having a side that tapers outwardly from the top of the body to the bottom thereof.

23. The cutting insert of claim 22 further comprising at least one chipbreaking indentation on each cutting surface.

* * * * *